United States Patent [19]

Trinh

[11] Patent Number: 4,512,677

[45] Date of Patent: Apr. 23, 1985

[54] NO RINSE LIQUID CAR CLEANER KIT WITH LIQUID CLEANER AND BRISTLE PAD

[75] Inventor: Toan Trinh, Maineville, Ohio

[73] Assignee: The Procter & Gamble Company, Cincinnati, Ohio

[21] Appl. No.: 401,805

[22] Filed: Jul. 26, 1982

[51] Int. Cl.[3] ..... A46B 1/00; B08B 1/00; B08B 3/00; C11D 3/12

[52] U.S. Cl. ..... 401/27; 401/200; 401/287; 252/89.1; 252/154; 252/88

[58] Field of Search ..... 252/8.6, 88, 89.1, 90, 252/154, 162, 163, 166, 167, 169, 174.13, 174.23, DIG. 1, DIG. 15, DIG. 2; 8/137, 142; 401/24, 27, 136, 200, 268, 283, 287; 502/402

[56] References Cited

U.S. PATENT DOCUMENTS

| | | | |
|---|---|---|---|
| 1,565,608 | 12/1925 | Walsh | 401/206 |
| 3,775,052 | 11/1973 | Van Paassen | 252/89.1 |
| 4,013,594 | 3/1977 | Froehlich et al. | 252/88 |
| 4,440,661 | 4/1984 | Takeuchi et al. | 252/88 |

*Primary Examiner*—Richard J. Apley
*Assistant Examiner*—Gregory Beaucage
*Attorney, Agent, or Firm*—Richard C. Witte; Ronald L. Hemingway; Leonard Williamson

[57] ABSTRACT

A car cleaning kit comprising a dispenser, a bristled fibrous applicator, and a substantially nonabrasive liquid cleaner composition. The kit is used to clean car surfaces without an external source of water to wash or rinse. The liquid cleaner is a composition of up to 30% polymeric solids, up to 95% liquid carrier and an effective amount of a suspension aid. It is used to clean painted, metal and vinyl surfaces. It does not leave unsightly residue embedded in the texture of vinyl surfaces.

6 Claims, 4 Drawing Figures

NO RINSE LIQUID CAR CLEANER KIT WITH LIQUID CLEANER AND BRISTLE PAD

BACKGROUND OF THE INVENTION

1. Field of the Invention

The present invention is a car cleaner kit which requires no external source of water to wash or rinse.

2. Description of the Prior Art

Car care products are numerous. Most car cleaners require large amounts of wash and rinse water. Those which do not require an external source of wash and rinse water contain a hard abrasive. A number of prior art auto cleaners are disclosed in *Household and Automotive Chemicals Specialties, Recent Formulations,* by E. W. Flick, Noyes Data Corporation, Park Ridge, N.J. 1979, pp. 293–326.

Current car cleaners/polishes utilizing mineral-based abrasives have problems associated with their use. Such abrasives are inherently comprised of relatively hard particles which abrade the painted surfaces. They are used in polishes to remove the top oxidized layer of the painted surfaces. Therefore, they should be used only occasionally. When these cleaners/polishes of the prior art are used regularly, such abrasive particles cause excessive wear to painted surfaces. The use of cleaners/polishes of the prior art which utilize such abrasives has also been known to damage the vinyl surfaces. A summary of this problem is discussed in "The Care of Automotive Vinyl Tops," a report of the Vinyl Top Study Task Force, the Chemical Specialties Manufacturers Association, published in *Chemical Times & Trends,* July 1978, pages 56–57. The abrasives are embedded in the texture of the vinyl, leave an unsightly residue, and mar the vinyl's appearance.

Polymeric solids have been used in cleaning compositions per se. For example, U.S. Pat. No. 4,108,800, issued to Helmut H. Froehlich on Aug. 22, 1978, discloses a cleaning composition wherein polyethylene glycol is added to semi-dry polymeric powdered cleaning compositions to prevent adherence of particles of the cleaning powder to the fabrics being cleaned.

The usefulness of polymeric solids in no-wash-or-rinse water auto cleaner formulations has not been recognized or appreciated in the prior art.

Furthermore, waterless car care products of the prior art such as waxes and cleaners/polishes are instructed to be applied by implements such as cloth, terry towels, or smooth foam pads, and require prior cleaning of the surfaces to remove the soils, lest the soils damage the surfaces.

SUMMARY OF THE INVENTION

The present invention is a car cleaning kit comprising a dispenser, a bristled fibrous applicator, and a substantially nonabrasive, liquid cleaner composition which cleans car surfaces without an external source of water to wash or rinse. The liquid cleaner is a composition of up to 30% polymeric solids, up to 95% liquid carrier and an effective amount of a suspension aid. It is used to clean painted, metal and vinyl surfaces. It does not leave unsightly residue embedded in the texture of vinyl surfaces.

The liquid car cleaner is applied to car surfaces with said bristled fibrous applicator. The applicator is comprised of resilient fibers and a base, said fibers having a length of from 3 to 15 mm, and a diameter of from 10 to 150 microns. The fibers are vertically attached (flocked or tufted) to the base at a density of at least 1000 fibers/cm$^2$. The applicator should have a minimum area of about 60 cm$^2$ for effective cleaning.

An object of the present invention is to provide a complete car cleaning kit which can be used without external source of water. Another object is to provide a substantially nonabrasive liquid car cleaner composition which can be used frequently on car body paint without substantial damage to the paint. Yet another object is to provide an improved vinyl cleaner. Still another object is to provide a resilient fibrous applicator to apply the cleaner composition and scrub soiled car surfaces without letting the soil damage the car surfaces.

DETAILED DESCRIPTION OF THE INVENTION

Figure 1:
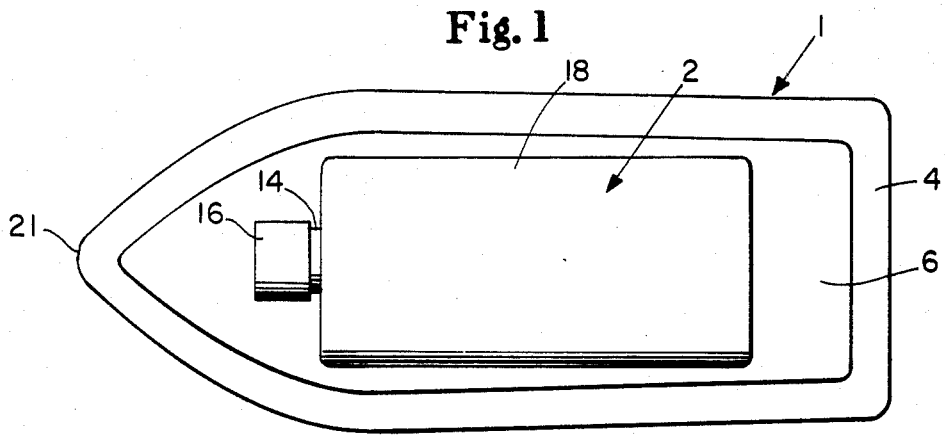
FIG. 1 is a top view of a preferred kit comprising a unitary construction of a container in communication with a flocked pad applicator.

The liquid car cleaner composition of this invention comprises organic polymeric solids selected from the group consisting of: porous and/or nonporous powdered particles in the particle size range of from 1 micron to about 250 microns; and polymeric fibers of diameter between 1 micron and 50 microns, and length between 0.1 millimeter to 3 millimeters. Porous and/or nonporous powdered polymeric particles can be used at a level of 30% by weight of the total composition. A preferred composition contains from 0.5% to 20% of polymeric particles, more preferably from 1% to 10%. But polymeric fibers should be used at a level of no more than about 10%. Optimum mixtures of fibers and powders can be formulated in the light of this disclosure. A liquid carrier is required and can be used at a level of up to 95% by weight of the composition. Water and aliphatic hydrocarbon solvents are used as the liquid carrier. Mixtures of water and aliphatic hydrocarbon solvents are preferred. A compatible organic suspending agent in sufficient amount to suspend the particles in the liquid carrier is also required. Both surfactants and thickeners are used as the suspending agent. The surfactants are also used as emulsifier and cleaning aid. Silicone is a preferred optional ingredient and can be used at a level of up to 20% by weight of the composition. Other optional ingredients such as waxes, fluorosurfactants, anticorrosion agents, antistatic agents, sunscreening agents, inorganic mild abrasives, pigments, perfumes, and preservatives can also be used for added benefits.

POLYMERIC SOLIDS

An essential element of the instant compositions is organic polymeric particulate materials which are suspended and dispersed throughout the fluid phase. Although the instant invention is not limited to any particular theory or mechanism, it is believed that inclusion of the solid materials in the compositions provides many beneficial effects: (1) promote the uniform spreading and coating of the liquid cleaner on the car surfaces and keep the liquid film uniform (for chemical cleaning) until the cleaner dries off; (2) provide large alternative surface areas to compete with the car surfaces themselves for the soil redeposition (after the soil is lifted up by scrubbing and chemical cleaning actions), when the cleaner is finally dried; (3) act as a soft buffer medium to coat and prevent hard particulate soils from scratching the car surface in this waterless cleaning execution; and (4) spherical-shape particulates provide lubricity by the ball bearing effect. Abrasive solids, when used, provide the polishing action to remove the dead paint layer for surface renewal, but cleaner containing abrasives can only be used occasionally, lest the paint layer is abraded away prematurely. The organic polymeric particulate solids are soft and essentially nonabrasive, therefore the incorporation of these materials in the preferred compositions enables car cleaning without the negative of excessive painted surface wear. Also because the organic polymeric particulates are softer than the common inorganic abrasives, larger size particulates can be used to avoid the deposition of these materials into the depressed areas of the textured vinyl surfaces, without being gritty and surface damaging.

The suitable polymeric particulate materials that can be used are described herein with their overall characteristics. They can be synthetic or naturally-occurring polymeric materials. Synthetic materials which can be utilized include, but are not limited to, polyethylene, polypropylene, polystyrene, polyester resin, urea-formaldehyde resin, polyvinyl chloride, polyacrylics, polyamide, and copolymers such as ethylenevinyl acetate copolymer and acrylonitrile-butadienestyrene terpolymer. Examples of naturally-occurring polymeric materials are cellulosic materials, such as wood powders and short cellulose fibers.

Polymeric particulate materials can be grouped into two general categories, namely, particles (or powders) and short fibers.

The powdery particles can have regular, spherical, or irregular shape. They can be solid or hollow. They can be porous or nonporous. The particle size is substantially in the range of from about 1 micron to about 250 microns.

The nonporous solid particles preferably have spherical shape. They provide both large surface area and lubricity. Some preferred nonporous polymeric particles are polyethylene powders described in "Microthene® F Microfine Polyolefin Powders," U.S. Industrial Chemicals Co., Division of National Distillers & Chemical Corp., New York, N.Y. 10016.

The porous particles are made of open cell microporous polymeric materials in which the small void spaces are interconnected. They provide large surface areas for soil deposition. Some preferred porous particles are polyethylene Accurel® powder, manufactured by Armak Company, Chicago, Ill. 60606 and described in "Versatile Microporous Polymers Developed," *Chemical & Engineering News,* Vol. 56, Dec. 11, 1978, pages 23–24, and urea-formaldehyde Capture® polymer, manufactured by Milliken Chemical, Division of Deering Milliken, Inc., Spartanburg, S.C. 29304 and described in U.S. Pat. No. 4,194,993, issued to James F. Deal III on Mar. 25, 1980.

Short fiber materials are particulates with elongated forms of diameter between 1 micron to 50 microns, and length between 0.1 millimeter to 3 millimeters. They can be obtained from finely cutting of the fiber filaments. The fibers can be solid or hollow. In the latter case, the fibers have porous property. The preferred short fibers are fibrillated fibers with small fibrils projecting from the surface of the fiber walls. Fibrillated fibers have large surface areas and are believed to have the ability of agglomerating the fine powders and dirt particles. Some preferred fibers are polyethylene Fybrel® and Short Stuff® fibrillated fibers manufactured by Minifibers, Inc., Weber City, Va. 24251, and polyethylene and polypropylene Pulpex® fibrillated fibers manufactured by Lextar, a Hercules/Solvay Company, Wilmington, Del. 19899.

The composition of this invention can consist of 0.1% to 30% by weight of porous and/or nonporous polymeric powder particles. A preferred composition of this invention consists of 0.5% to 20% of porous and/or nonporous polymeric particles. A more preferred composition can consist of from 1% to 10% by weight of these particles. Yet another composition of this invention can consist of from 0.1% to 10% by weight of polymeric short fibers. The polymeric solids of this invention can consist of mixtures of powder and fibers, preferably at a ratio of from 20:1 to 1:1 by weight.

Preferred nonporous polymeric powder particles of this invention are: (a) polyethylene of particle size from 5 microns to 150 microns, and used at 0.1% to 30% by weight of the composition; (b) polyethylene of particle size 5 microns to 100 microns, and used at 2% to 15% by weight of the composition; (c) polyethylene particles of particle size 5 microns to 30 microns, and used at 2% to 10% by weight of the composition.

Preferred porous polymeric particles are: (a) urea-formaldehyde polymer 30 microns to 100 microns and used at 0.1% to 30%; (b) polyethylene 30 microns to 150 microns and used at 1.0% to 20%.

Preferred fibers are fibrillated polyethylene fibers of: (a) 1 micron to 50 microns in diameter at 0.1 millimeter to 3.0 millimeters in length and used at 0.1% to 10% by weight of the composition; (b) about 10 microns in diameter at 0.5 millimeter to 1.25 millimeters in length and used at 0.5% to 5% by weight of the composition.

Mixture of porous and/or nonporous particles and fibrillated fibers are also preferred at level of up to 30% and with amount of fibrillated fibers of not more than 10% by weight of the composition. A more preferred composition consists of a mixture of said polymeric particles and said fibers at a ratio of from 20:1 to 1:1 by weight, and at level of from 0.5% to 20% by weight of the composition.

LIQUID CARRIERS

The composition of this invention can contain 2% to 90% by weight of an aliphatic hydrocarbon solvent with boiling points of from 90° C. to 300° C. or 95% to 95% by weight of the hydrocarbon solvent and water. Liquid carriers comprising mixtures of water and aliphatic hydrocarbons (oil) are preferred. Ratios of 9:1 to 1:9 of water to oil are suitable, and ratios of from 1:1 to 3:1 are preferred. These mixtures are preferably used at 60% to 95%, and more preferably at 70% to 90% by weight of the composition. Preferred amounts of water used in the water-and-oil mixtures are: (a) 30% to 70%; and (b) more preferably 50% to 65% by weight of the total composition.

Preferred aliphatic hydrocarbon solvents are: (a) Stoddard Solvent, boiling point 160°–180° C.; (b) Isopar® L Solvent (isoparaffinic hydrocarbon solvent produced by Exxon Co., Baltimore, Md. 21203), boiling point of 188°-207° C.; (c) Mineral spirits, boiling point 120°-190° C.; and (d) Mixture of Stoddard Solvent (160°-180° C.) and odorless kerosene (190°-255° C.) at 1:1 to 5:1 weight ratio, all used at 10% to 30%; and more preferably 20% to 30% by weight of the total composition.

SUSPENDING AGENTS

The suspending agents useful in this invention are suitable surfactants and thickeners and mixtures thereof. These surfactant suspending agents have the properties of dispersing solid particles and liquid droplets. They are used to disperse the polymeric particles throughout the cleaner compositions. Most of the cleaning compositions of this invention contain both oil and water phases. The surfactants also stabilize the emulsion of these two phases. The surfactants are also included to aid in the cleaning of the car surfaces. Substantially any surfactant materials which are compatible with the other components in the composition of this invention can be utilized. These include nonionic, anionic, cationic, amphoteric and zwitterionic surfactants. The composition of this invention can consist of up to 10% by weight of a suspending agent surfactant; preferably between 0.4% and 2%.

The stability of the dispersion and emulsion can also be achieved or further enhanced by addition of a thickener suspending agent to increase the viscosity of the suspending and emulsifying medium.

Thickener suspending agents that can be utilized include, but are not limited to, salts of polyacrylic acid polymer, sodium carboxymethyl cellulose, hydroxyethyl cellulose, acrylic ester polymer, polyacrylamide, polyethylene oxide, natural polysaccharides such as gums, algins, pectins. They are used at effective levels of up to 10%.

Preferred thickeners are salts of polyacrylic acid polymer of high molecular weights. Examples of polyacrylic acid polymers are Carbopol® resins which are described in "Carbopol® Water Soluble Resins," Publication No. GC-67, The B. F. Goodrich Co., Cleveland, Ohio 44131. Carbopol® resins can be used in the composition of this invention at a level from about 0.05% to about 0.5%, preferably Carbopol® 934 used at 0.1% to 0.2% by weight of the total composition. Sodium hydroxide and other inorganic and organic bases are utilized in the compositions of this invention at effective levels to neutralize the Carbopol® thickeners, as described in the publication mentioned above.

A preferred thickener suspending agent which is utilized in nonaqueous compositions is glyceryl tris-12-hydroxystearate manufactured under the name of Thixcin R® by NL Industries, used preferably in the range of from 0.2% to 2% by weight of the total composition.

OPTIONAL INGREDIENTS

Compatible optional ingredients can be used in the composition of this invention for added benefits. Silicone is a preferred optional component. Silicone materials provide or enhance the gloss/shine appearance of car surfaces, improve the ease of application and removal of the cleaner, and make the car surfaces water repellent for added protection. Silicone materials which can be used include, but are not limited to, dimethyl silicones, aminosilicones, silicone resins, volatile silicones, and mixtures thereof. Preferred silicones are the dimethyl silicones and aminosilicones. Examples of dimethyl silicones are the Dow Corning® 200 Fluids of various viscosities, manufactured by Dow Corning Corp., Midland, Mich. 48640. Examples of aminosilicones are the Dow Corning® 531 and 536 Fluids. These Dow Corning® Fluids will be referred to hereinafter by the abbreviated name "DC". Silicone materials can be used in the composition of this invention at a level of up to 20%. Preferred silicone materials and levels are: (a) DC-200, viscosity 50-10,000 centistokes, used at 1% to 10%; (b) DC-200, viscosity 100-1000 centistokes, used at 2% to 6%; and (c) mixture of DC-531 and DC-536 at 3:1 to 6:1 weight ratio, and at 1% to 10% by weight of the total composition.

Other optional ingredients that can be used in the composition of this invention include, but are not limited to, waxes for surface protection, fluorosurfactants for spreadability and leveling, other organic solvents for greasy soil cleaning, anticorrosion agents, antistatic agents, pigments, perfumes, preservatives.

Mild inorganic abrasives such as calcium carbonate powder can also be used when polishing action is desired so long as they do not leave unsightly residue on textured vinyl surfaces.

DISPENSER AND APPLICATOR

In this dry cleaning execution it is essential that the application implement has a construction such that it: (1) provides effective spreading and scrubbing, resulting in good cleaning and uniform end result appearance on painted surfaces; (2) prevents the gritty soil particles from incurring scratches to the painted surfaces; and (3) can reach to dislodge the embedded soil in the depressed areas of the textured vinyl surfaces.

It was discovered that a bristle-fibered pad with the defined fiber construction (as described herein) can be used to apply the active composition to clean soiled car painted surfaces virtually without damaging those surfaces. Although the instant invention is not limited to any particular theory or mechanism, it is believed that the bristle-fibered application pad provides the desired properties for surface-safe cleaning because: (1) It has enough void volume to hold the gritty soil particles and to keep them away from the car surfaces, thus preventing them from scratching the car surfaces; (2) It has vertical fibers that stay essentially unbent under normal hand scrubbing pressure to keep the gritty soil particles in the void spaces and away from the car surfaces (long and/or thin fibers bend under this pressure and push some gritty particles onto the surface); (3) It has straight vertical fibers which can reach depressed areas of the textured vinyl surface; and (4) It has high surface fiber density (number of fibers per unit area) to provide effective scrubbing and cleaning for good end result appearance.

The applicator/scrubbing pad is constructed essentially of bristled fibers secured vertically to a base. Flocking is a preferred method of fiber attachment. In this preferred method, the fibers are attached to the base by electrostatic flocking for good vertical fiber alignment, using a flocking adhesive such as an acrylic adhesive made from Rhoplex® resin manufactured by Rohm and Haas Co., Philadelphia, Pa. 19105. Tufting is also a preferred method of fiber attachment: pile fabric which consists of fibers vertically tufted into a woven yarn substrate. The fabric is then adhesively laminated to the base. The fibers are made of resilient polymeric materials, preferably nylon, polypropylene, acrylic, modacrylic, polyester.

Following are the requirements of fiber composition and pad construction for a good performing applicator/scrubbing pad:

1. Fiber density of at least 500 fibers/cm$^2$ to provide effective scrubbing and cleaning.

2. Said fibers have a minimum fiber length of 3 mm so that they can reach to scrub and clean the depressed areas of the textured vinyl surfaces.

3. Said applicator/scrubbing pad must have a large enough surface area for fast cleaner application and scrubbing of the total car exterior surfaces. The pad surface area should be at least 60 cm$^2$.

4. The fibers must be aligned substantially vertically to the base, and the fibers must remain essentially unbent under normal hand scrubbing pressure.

The last requirement above can be defined by the "Yield Force" which is the minimum force needed to bend the fibers of the pad. The Yield Force of the pad must be greater than the normal hand scrubbing force of 22–36 Newtons (5–8 lbs.). The Yield Force of a pad is a collective property affected by many factors, which include fiber material, fiber length, fiber diameter, fiber density, fiber orientation (relative to base), nature of the base, and total pad surface area. The Yield Force of a pad can be measured directly with an Instron tester (see below), or calculated from the "Yield Pressure" and the pad surface area by the relation:

Yield Force = Yield Pressure x pad surface area.

Yield Pressure is the minimum force exerted vertically upon a unit area of the pad to bend the fibers.

Yield Pressure is determined by the same procedure of the Compression Test as described in the standard method ASTM D-695 by using an Instron tester, Model TM, manufactured by the Instron Corp., Canton, Mass. 02021. A fibrous pad cut to a predetermined surface area A is placed on the compression cell of the Instron tester. Test specimens of square or circular form with surface area of between 58 cm$^2$ and 182 cm$^2$ are recommended. Testing speed of 0.51 cm/min. (0.2 in./min.) is recommended. The force F required to bend the fibers is read from the load indicator recording chart. The Yield Pressure is the ratio F/A.

Examples of fibrous materials used in the construction of the applicator/scrubbing pad of this invention are listed in Table 1. The Yield Pressures of these materials are listed in Table 2.

TABLE 1

| Ex. | Pad Surface | Fiber Length (mm) | Fiber Diameter (μm) | Fiber Density (fib/cm$^2$) | Fiber Mat'l | Others |
|---|---|---|---|---|---|---|
| 1 | Padco ® | 4.6 | 47 | 1880 | Nylon | a, c, g |
| 2 | Padco ® | 4.6 | 47 | 1880 | Nylon | a, d, g |
| 3 | Padco ® | 4.6 | 47 | 1880 | Nylon | a, e, g |
| 4 | IF-455 | 5.6 | 43 | 3570 | PP[i] | b, f, h |
| 5 | IF-456 | 5.1 | 43 | 3570 | PP[i] | b, f, h |
| 6 | IF-457 | 4.6 | 43 | 3570 | PP[i] | b, f, h |
| 7 | IF-458 | 4.1 | 43 | 3570 | PP[i] | b, f, h |
| 8 | Scrubber ® | 5.6 | 49 | 8120 | PP[i] | b, f, h |
| 9 | IF-498 | 5.8 | 44 | 2970 | Nylon | b, f, h |
| 10 | IF-507 | 6.9 | 44 | 2970 | Nylon | b, f, h |

Method of attachment of fibers to base:

(a) flocked (b) tufted

Base construction:

(c) polyurethane foam, 1.6 mm thick (d) polyurethane foam, 4.8 mm thick (e) polyurethane foam, 7.9 mm thick (f) woven yarn Manufacturers:

(g) Padco, Inc., Minneapolis, Minnesota 55414;

TABLE 1-continued (h) Collins & Ackman Corp., Roxboro, North Carolina 27573

Fiber Material:

(i) PP = polypropylene

TABLE 2

| Ex. | Pad Surface (Described in Table 1) | Yield Pressure (psi) | Yield Pressure (× 10$^3$N/m$^2$) |
|---|---|---|---|
| 1 | Padco ® | 1.05 | 7.2 |
| 2 | Padco ® | 0.80 | 5.5 |
| 3 | Padco ® | 0.65 | 4.5 |
| 4 | IF-455 | 1.75 | 12.1 |
| 5 | IF-456 | 2.35 | 16.2 |
| 6 | IF-457 | 3.85 | 26.5 |
| 7 | IF-458 | 3.85 | 26.5 |
| 8 | Scrubber ® | 10.00 | 69.0 |
| 9 | IF-498 | 2.00 | 13.8 |
| 10 | IF-507 | 1.70 | 11.7 |

To calculate the Yield Force of an applicator/scrubbing pad, one first determines the Yield Pressure of the fibrous material and the desired surface area of the pad, then takes the product of the two values. An acceptable applicator/scrubbing pad of this invention must have a Yield Force greater than the normal hand scrubbing force of 36 Newtons (8 lbs.). Example: An applicator/scrubbing pad, with a surface area of 116 cm$^2$ (18 in.$^2$) and constructed with Padco flocked material with 4.8 mm thick polyurethane foam base (Example 2 of Table 1) has a Yield Force of 64 Newtons (14.4 lbs.) which is greater than 36 Newtons, therefore satisfies the requirement number 4 above.

Preferably fibers have length of from 3 mm to 15 mm and diameter of from 10 microns to 150 microns. Fiber density is at least 500 fibers/cm$^2$; more preferably at least 1500 fibers/cm$^2$. Examples of flocked and tufted materials that can be used for the applicator/scrubbing pad of this invention are listed in Table 1.

The base of the applicator/scrubbing pad can be a foam pad or a semi-rigid but flexible plastic film. The preferred base is a close-cell foam pad with fine pores, preferably more than 20 pores per linear centimeter. A preferred foam pad is made of close-cell polyurethane foam with 28–32 pores per linear centimeter. Preferred foam thickness is from 1 mm to 10 mm.

Figure 3:
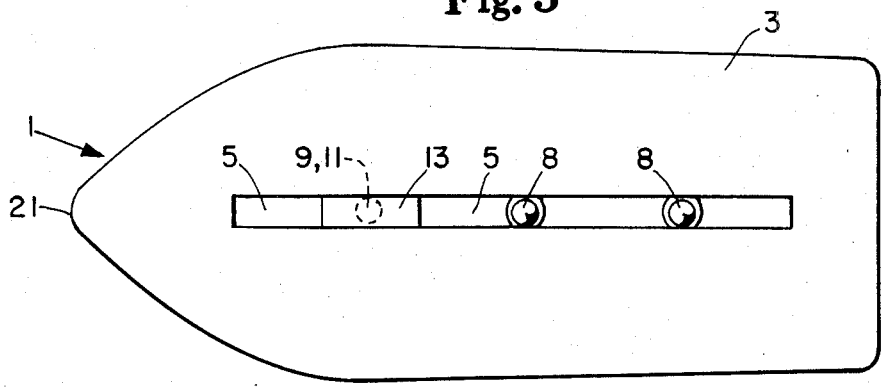
FIG. 3 is a planar view of the kit viewed from the bottom showing a means of delivering the cleaning composition in the container to the surface to be cleaned.

Preferably the fibers cover the total application surface of the pad. The pad has a minimum surface area of 60 cm$^2$, preferably from 100 cm$^2$ to 200 cm$^2$. A more preferred pad has dimensions of about 8 cm × 20 cm. Preferably it has one long end tapered into a point to enable the pad to clean tight spots, as depicted in FIGS. 1 and 3.

The dispenser can be made of any materials which are compatible with the cleaner composition, such as metal or plastic materials, preferably polyethylene and polypropylene. The dispenser preferably has a palmfitting shape with resilient side walls. The dispenser has opening means for cleaner loading and dispensing. In a preferred construction the dispenser has a dispensing valve such as a diaphragm valve described in U.S. Pat. No. 4,226,342, issued to Robert H. Laauwe on Oct. 7, 1980, or a duckbill valve available from Vernay Laboratories, Inc., Yellow Springs, Ohio 45387.

For convenience, it is preferable that the dispenser and the pad are of a unitary construction, in which a palm-fitting container holding a predetermined amount of liquid cleaner composition is positioned on top of the applicator/scrubbing base with a means to dispense the liquid cleaner to the car surfaces. The dispensing means can be an aperture opening through the applicator pad or at the tip of the pad. The aperture can be sealed initially with a thin plastic film which is punctured to discharge the cleaner. For the through-the-pad dispensing method, the dispensing aperture can be adapted with a diaphragm valve. For the through-the-tip dispensing method, the dispensing aperture can be adapted with a duckbill valve. Preferably the container has a capacity and contains of from about 150 $cm^3$ to 300 $cm^3$ of the liquid cleaner.

DESCRIPTION OF THE DRAWINGS

Figure 2:
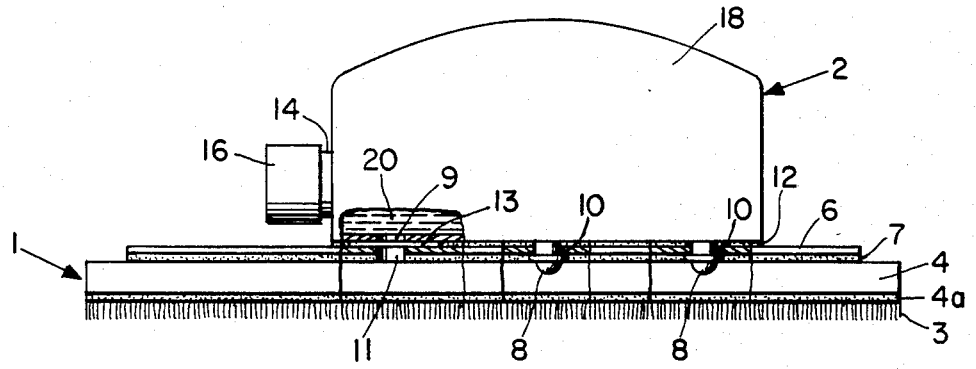
FIG. 2 is a side view of the kit construction of FIG. 1.
Figure 4:
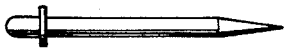
FIG. 4 shows a puncturing device.

FIGS. 1 and 2 show, respectively, top and side views of a preferred dispenser/applicator kit which is used to apply the liquid cleaner. FIG. 3 is a bottom view of the kit. FIG. 4 shows a puncturing device. This dispenser-/applicator kit comprises: an applicator/scrubbing pad 1 and a container 2 which contains the liquid cleaner 20.

The applicator/scrubbing pad 1 has bristle flocked fibers 3 secured to a base 4 with an acrylic flocking adhesive 4*a*. Pad 1 has a slit opening 5 as shown in FIG. 3. The pad has dimensions of about 8 cm×20 cm. It has one long end 21 tapered into a point to enable the pad to clean tight spots, as depicted in FIG. 3. The pad construction consists of nylon fibers 3 of 4.6 cm length, 47 microns diameter (18 denier) flocked onto a close-cell foa pad 4 to a density of about 1900 fibers/$cm^2$ (172 $g/m^2$). The foam pad 4 is made of close-cell polyurethane foam with 28–32 pores per linear centimeter. The foam pad 4 has a thickness of 4.8 cm. The foam is attached to a semi-rigid plastic base 6 by means of a suitable adhesive 7, such as a hot melt adhesive. The container 2 has a palmfitting shape with resilient side walls 18. The container 2 is made by blow molding polyethylene. The container has a capacity of 230 $cm^3$. The container 2 is positioned on top of the base 6 by close-fitting annular projections 8 into the openings 10 in base 6. The container 2 is secured to the base 6 by using a suitable adhesive 12, such as a hot melt adhesive. The container 2 has an aperture means 9 through which the cleaner 20 will be dispensed. This aperture 9 is aligned with the opening 11 of the base 6 and the opening 5 of the pad 1. The aperture 9 is initially sealed off by a thin plastic film 13, such as a pressure sensitive tape. The reservoir 2 also has an opening 14, with circumferential groove (not shown) and a screw cap means 16, via which the cleaner 20 is loaded or refilled.

To discharge the cleaner 20, the sealing film 13 is first punctured via opening 5 using a sharp puncturing device as shown in FIG. 4. Then the cleaner can be discharged from the container to the surface to be cleaned via the aperture 9 by hand pressure to the side walls 18.

It will be understood that other embodiments of the dispenser/applicator kit come within the scope of this disclosure, e.g., the bristled pad can take the form of a mitten made of flocked material and the liquid cleaner can be in a separate plastic bottle dispenser.

END RESULT APPEARANCE PERFORMANCE TEST

This is a test method to evaluate the end result appearance performance of the cleaner compositions on painted and textured vinyl surfaces. A composition is considered acceptable if after use (as described below), it leaves a uniform appearance on painted surfaces, i.e., substantially free of streaks, and does not leave any appreciable amount of unsightly residue embedded in the texture of the vinyl surface.

TEST PROCEDURE

Test painted surfaces are black acrylic enamel painted plates of dimension 30.5 cm×30.5 cm. Test vinyl surfaces are textured vinyl sheets of dimension 30.5 cm×30.5 cm. This car top vinyl material with Milano grain pattern, color M398 (Midnite Blue), is manufactured by Weymouth Art Leather Co., South Braintree, Mass. 02184.

The cleaner compositions are applied to the test surfaces with fiber-flocked foam pads of 5.1 cm×7.6 cm pad surface dimensions. These pads are comprised of a close-cell polyurethane foam base of 9.5 millimeters thickness and flocked with 18 denier nylon fibers of 4.6 mm fiber length, and flock density of 172 $g/m^2$. The pad material is manufactured by Padco, Inc., Minneapolis, Minn. 55414.

All cleaning tests are performed in a laboratory with controlled temperature and humidity conditions, namely, 27° C. and 15% relative humidity.

Two milliliters of a cleaner composition is dispensed to the test surface and spread with a fiber-flocked foam pad to cover the surface with a circular rubbing motion. The cleaner is let dry to a powdery haze, then the haze is wiped off with a terry cloth, and the surface appearance evaluated.

The following examples are given for purposes of illustration only and are not to be interpreted as necessarily limiting the invention. All percentages are by weight unless otherwise indicated.

EXAMPLE I

| Raw Materials & Source | Wt. % | Chemical Description |
|---|---|---|
| 1. Stoddard Solvent (Fisher) | 26.0 | Petroleum distillates (b.p. 153–210° C.) |
| 2. DC-200 ® Silicones (350 cts) (Dow Corning) | 4.0 | Polydimethylsiloxane |
| 3. Calamide ® C Surfactant (Pilot Chemical) | 1.0 | Coconut diethanolamide |
| 4. Carbopol ® 934 Thickener (2% solution) (B. F. Goodrich) | 10.0* | Polyacrylic acid polymer |
| 5. Deionized Water | 50.95* | |
| 6. Sodium Hydroxide (10% solution) | 1.05* | |
| 7. Short Stuff ® 13040F Fibers (Minifibers) | 1.0 | Polyethylene fibrillated fibers (0.8–1.05 mm fiber length) |
| 8. Microthene ® FA-520 Powder (USI Chemicals) | 4.0 | Polyethylene powder (20 micron particle size) |
| 9. Capture ® Polymer (Milliken Chemicals) | 2.0 | Urea-Formaldehyde porous powder (40–110 micron particle size) |
| Total | 100.00% | |

*Total water is 60.695%.

PREPARATION DIRECTIONS FOR EXAMPLE I

Step I: Add 2 and 3 to 1 with stirring.
Step II: Separately prepare solution 4 and solution 6.
Step III: Add 4 to 5 with continuous stirring.

Step IV: Add 6 to the mixture of Step III with good stirring until the mixture thickens uniformly.

Step V: Add the mixture of Step I to the mixture of Step IV with continuous stirring to form a thick, smooth, creamy emulsion.

Step VI: Add 7, 8 and 9, in that order, to the mixture of Step V with continuous stirring until all are well dispersed.

The composition of Example I contains a total of about 7% polymeric solids, 87% liquid carrier, 1.3% suspending agents and 4% silicone. End Result Appearance Tests showed that the composition of Example I is acceptable for painted and vinyl surfaces.

The composition of Example I requires no prewashing or rinsing of car surface before use. However, one may wish to remove heavy soil such as caked mud prior to using the product. The product is good for cleaning most exterior car surfaces. For best results, user should avoid direct sunlight and allow car to cool before use.

USAGE INSTRUCTIONS

1. Shake the cleaner to assure uniformity.
2. Apply on car surfaces, preferably with the container/applicator kit as shown in the drawings.
3. Start at the top of car and work down. Spread product to cover surface with a uniform film. Rub with circular motion.
4. Let product dry to powdery haze, loosened dirt and grime will be trapped as the product dries to a powdery haze.
5. Wipe off haze with clean cloths and turn cloths frequently.

OTHER EXAMPLES

In general, the compositions of the following Examples were made by following the procedure of Example I, namely, by: (1) mixing the silicone and the surfactant into the organic solvent (oil) phase, (2) mixing the Carbopol thickener and neutralizers into the water phase, (3) mixing the oil phase into the water phase, and (4) adding the polymeric particulate solids to the liquid emulsion with continuous stirring until they are uniformly dispersed. Any variations to this procedure are noted under the appropriate Examples. The preferred order of addition of the particulate solids is fibers first, then nonporous particles, and finally porous particles. High shear mixing for a short period of time after all ingredients have been added is preferred in order to break up any clumping of the solid materials, and to achieve thorough mixing.

| Ingredients | Ex. II | Ex. III* |
|---|---|---|
| Microthene ® FA-520 Polyethylene Powder (USI Chemicals) | 6.0 | — |
| Capture ® Polymer Urea-Formaldehyde Porous Powder (Milliken Chemicals) | 2.0 | — |
| Short Stuff ® 13040 Polyethylene Fibrillated Fibers (Minifibers) | 1.0 | — |
| Snowflow ® Diatomaceous Silica (Johns Manville) | — | 9.0 |
| Stoddard Solvent Petroleum Distillates | 26.0 | 26.0 |
| DC-200 ®, 350 cts (Dow-Corning) | 4.0 | 4.0 |
| Oleic Acid | 1.0 | 1.0 |
| Carbopol ® 934 Polyacrylic Acid Resin (2% solution) (B. F. Goodrich) | 5.0 | 5.0 |
| Triethanolamine (2% solution) | 5.0 | 5.0 |
| Morpholine | 0.6 | 0.6 |
| Deionized Water | 49.4 | 49.4 |
| Totals | 100.0 | 100.0 |
| Residue on Vinyl | No | Heavy |

*Outside scope of the present invention.

EXAMPLE II

Procedure of Example I, except that the fibrillated fibers are added to the water phase.

EXAMPLE III

Procedure of Example I, with both neutralizers, namely, triethanolamine and morpholine, are added to the water phase, and oleic acid is added to the oil phase.

| Ingredients | Ex. IV* | Ex. V |
|---|---|---|
| Microthene ® FA-520 Polyethylene Powder (USI Chemicals) | — | 4.0 |
| Capture ® Polymer Urea-Formaldehyde Porous Powder (Milliken Chemicals) | — | 2.0 |
| Short Stuff ® 13040 Polyethylene Fibrillated Fibers (Minifibers) | — | 1.0 |
| Snowflow ® Diatomaceous Silica (Johns Manville) | 9.0 | — |
| Gelwhite ® GP Montmorillonite Clay (8% dispersion) (Georgia Kaolin) | 12.5 | — |
| Stoddard Solvent Petroleum Distillates | 26.0 | 26.0 |
| DC-200 ®, 350 cts (Dow-Corning) | 4.0 | 4.0 |
| Oleic Acid | 1.0 | — |
| Dodecylamine | — | 0.2 |
| Dimethyldodecylamine | — | 0.2 |
| Carbopol ® 934 Polyacrylic Acid Resin (2% solution) (B. F. Goodrich) | — | 10.0 |
| Sodium Hydroxide (10% solution) | — | 0.8 |
| Morpholine | 0.6 | — |
| Deionized Water | 46.9 | 51.8 |
| Totals | 100.0 | 100.0 |
| Residue on Vinyl | Heavy | No |

*Outside scope of the present invention.

EXAMPLE IV

Add clay, diatomaceous silica and morpholine to the water phase, and oleic acid to the oil phase.

EXAMPLE V

Procedure of Example I, with the amines added to the oil phase.

| Ingredients | Ex. VI | Ex. VII |
|---|---|---|
| Microthene ® FA-520 Polyethylene Powder (USI Chemicals) | 29.0 | 10.0 |
| Stoddard Solvent Petroleum Distillates | 26.0 | 26.0 |
| DC-200 ®, 350 cts (Dow-Corning) | 4.0 | 4.0 |
| Calamide ® C Cocodiethanolamide (Pilot Chemical) | 1.0 | 1.0 |

-continued

| Ingredients | Ex. VI | Ex. VII |
|---|---|---|
| Carbopol ® 934 Polyacrylic Acid Resin (2% solution) (B. F. Goodrich) | 10.0 | 10.0 |
| Sodium Hydroxide (10% solution) | 1.05 | 1.05 |
| Deionized Water | 28.95 | 47.95 |
| Totals | 100.00 | 100.00 |
| Residue on Vinyl | Slight | No |

EXAMPLE VI

Add half of the solids to the water phase, the other half to the oil phase, then add oil phase to water phase.

| Ingredients | Ex. VIII | Ex. IX |
|---|---|---|
| Capture ® Polymer Urea-Formaldehyde Porous Powder (Milliken Chemicals) | 29.0 | 18.0 |
| Stoddard Solvent Petroleum Distillates | 26.0 | 26.0 |
| DC-200 ®, 350 cts (Dow-Corning) | 4.0 | 4.0 |
| Calamide ® C Cocodiethanolamide (Pilot Chemical) | 1.0 | 0.5 |
| Carbopol ® 934 Polyacrylic Acid Resin (2% solution) (B. F. Goodrich) | 10.0 | 10.0 |
| Sodium Hydroxide (10% solution) | 1.05 | 1.05 |
| Deionized Water | 28.95 | 40.45 |
| Totals | 100.00 | 100.00 |
| Residue on Vinyl | No | No |

EXAMPLE VIII

Procedure of Example VI.

| Ingredients | Ex. X | Ex. XI |
|---|---|---|
| Capture ® Polymer Urea-Formaldehyde Porous Powder (Milliken Chemicals) | 8.0 | — |
| Accurel ® Polyethylene Porous Powder (Armak) | — | 7.0 |
| Stoddard Solvent Petroleum Distillates | 26.0 | 26.0 |
| DC-200 ®, 350 cts (Dow-Corning) | 4.0 | 4.0 |
| Calamide ® C Cocodiethanolamide (Pilot Chemical) | 0.5 | 0.5 |
| Carbopol ® 934 Polyacrylic Acid Resin (2% solution) (B. F. Goodrich) | 10.0 | 10.0 |
| Sodium Hydroxide (10% solution) | 1.05 | 1.05 |
| Deionized Water | 50.45 | 51.45 |
| Totals | 100.00 | 100.00 |
| Residue on Vinyl | No | No |

EXAMPLE XI

Procedure of Example I, except the solid powder is added to the oil phase.

| Ingredients | Ex. XII | Ex. XIII | Ex. XIV |
|---|---|---|---|
| Short Stuff ® 13040 Polyethylene Fibrillated Fibers (Minifibers) | 10.0 | 7.0 | 3.0 |
| Stoddard Solvent Petroleum Distillates | 26.0 | 26.0 | 26.0 |
| DC-200 ®, 350 cts (Dow-Corning) | 4.0 | 4.0 | 4.0 |
| Calamide ® C Cocodiethanolamide (Pilot Chemical) | 1.0 | 0.5 | 0.5 |
| Carbopol ® 934 Polyacrylic Acid Resin (2% solution) (B. F. Goodrich) | 10.0 | 10.0 | 10.0 |
| Sodium Hydroxide (10% solution) | 1.05 | 1.05 | 1.05 |
| Deionized Water | 47.95 | 51.45 | 55.45 |
| Totals | 100.00 | 100.00 | 100.00 |
| Residue on Vinyl | No | No | No |

Examples XII, XIII, and XIV: Procedure of Example XI.

| Ingredients | Ex. XV | Ex. XVI | Ex. XVII |
|---|---|---|---|
| Microthene ® FA-520 Polyethylene Powder (USI Chemicals) | 5.0 | 8.0 | — |
| Capture ® Polymer Urea-Formaldehyde Porous Powder (Milliken Chemicals) | 4.0 | — | 8.0 |
| Short Stuff ® 13040 Polyethylene Fibrillated Fibers (Minifibers) | — | 1.0 | 1.0 |
| Stoddard Solvent Petroleum Distillates | 26.0 | 26.0 | 26.0 |
| DC-200 ®, 350 cts (Dow-Corning) | 4.0 | 4.0 | 4.0 |
| Dodecylamine | 0.2 | 0.2 | 0.2 |
| Dimethyldodecylamine | 0.2 | 0.2 | 0.2 |
| Carbopol ® 934 Polyacrylic Acid Resin (2% solution) (B. F. Goodrich) | 10.0 | 10.0 | 10.0 |
| Sodium Hydroxide (10% solution) | 0.52 | 0.52 | 0.52 |
| Deionized Water | 50.08 | 50.08 | 50.08 |
| Totals | 100.00 | 100.00 | 100.00 |
| Residue on Vinyl | No | No | No |

EXAMPLE XVI

Procedure of Example I, except the fibers are added to the water phase.

| Ingredients | Ex. XVIII | Ex. XIX | Ex. XX |
|---|---|---|---|
| Microthene ® FA-520 Polyethylene Powder (USI Chemicals) | 5.0 | 4.0 | 8.5 |
| Capture ® Polymer Urea-Formaldehyde Porous Powder (Milliken Chemicals) | 3.0 | 2.0 | 2.0 |
| Accurel ® Polyethylene Porous Powder (Armak) | — | 2.0 | — |
| Short Stuff ® 13040 Polyethylene Fibrillated Fibers (Minifibers) | 1.0 | 1.0 | 0.5 |
| Stoddard Solvent Petroleum Distillates | 26.0 | 26.0 | 19.5 |
| Kerosene (Deodorized) | — | — | 6.5 |
| DC-200 ®, 350 cts (Dow-Corning) | 4.0 | 4.0 | 4.0 |
| Calamide ® C Cocodiethanolamide (Pilot Chemical) | — | — | 1.0 |
| Dodecylamine | 0.2 | 0.2 | — |
| Dimethyldodecylamine | 0.2 | 0.2 | — |
| Carbopol ® 934 Polyacrylic Acid Resin (2% solution) | 10.0 | 10.0 | 5.0 |

-continued

| Ingredients | | Ex. XVIII | Ex. XIX | Ex. XX |
|---|---|---|---|---|
| (B. F. Goodrich) | | | | |
| Sodium Hydroxide (10% solution) | | 0.52 | 0.52 | 0.53 |
| Deionized Water | | 50.08 | 50.08 | 52.47 |
| | Totals | 100.00 | 100.00 | 100.00 |
| Residue on Vinyl | | No | No | No |

EXAMPLE XIX

All particles are added to the water phase, fibers to the oil phase, then add oil phase to water phase.

| Ingredients | | Ex. XXI | Ex. XXII |
|---|---|---|---|
| Microthene ® FA-520 Polyethylene Powder (USI Chemicals) | | 4.0 | 4.0 |
| Capture ® Polymer Urea-Formaldehyde Porous Powder (Milliken Chemicals) | | 2.0 | — |
| Accurel ® Polyethylene Porous Powder (Armak) | | — | 5.5 |
| Short Stuff ® 13038F Polyethylene Fibrillated Fibers (Minifibers) | | 1.0 | 0.5 |
| Stoddard Solvent Petroleum Distillates | | — | 89.0 |
| Thixcin R ® Glyceryl tris-12-hydroxystearate suspending agent (NL Industries) | | — | 1.0 |
| Carbopol ® 940 Polyacrylic Acid Resin (1% aqueous solution) (B. F. Goodrich) | | 5.0 | — |
| Sodium Hydroxide (10% solution) | | 0.26 | — |
| Deionized Water | | 87.74 | — |
| | Totals | 100.00 | 100.00 |
| Residue on Vinyl | | No | Very slight |

EXAMPLE XXII (1) Warm the Stoddard Solvent to 50° C. in a water bath; (2) sprinkle Thixcin R ® into the Stoddard Solvent (still in the water bath) with vigorous stirring using a cutting blade paddle; (3) the mixture is subjected to high sheer mixing; (4) add the solids with continuous stirring; (5) the final composition (at 50° C.) is subjected to high sheer mixing; and (6) stir the mixture with a cutting blade paddle until cooled down to room temperature.

Compositions of Examples III and IV which contain diatomaceous silica abrasives, and clay and diatomaceous silica abrasives, respectively, left heavy residues on vinyl surfaces according to the End Result Appearance Performance Test, and fall outside the scope of the present invention. Compositions of all other Examples contain organic polymeric particulates, left no residue or only very small amount of residues, fall within the scope of this invention.

What is claimed is:

1. A car cleaner kit comprising a dispenser containing a predetermined amount of a liquid car cleaner composition and a pad for applying said liquid car cleaner on said car, said pad having resilient fibers and a base, said fibers attached substantially vertically to said base, said fibers having a length of from 3 to 15 mm, a diameter of from 10 to 150 microns, said fibers being attached to said base at a density of at least 500 fibers/cm$^2$, said base having a minimum surface area of 60 cm$^2$, said pad has a Yield Force of at least 36 Newtons, said liquid cleaner having:

I. from 0.1% to 30% by weight of insoluble organic polymeric solids selected from the group consisting of:

A. polymeric particles of particle size in the range of from 1 micron to about 250 microns;

B. polymeric fibers of diameter between 1 micron and 50 microns, and length between 0.1 millimeter to 3 millimeters;

said polymeric solids can consist essentially of up to 100% of said polymeric particles at said 30%, said polymeric solids can consist essentially of 100% of said fibers at 10%;

II. from about 20% to about 95% of a liquid carrier for said particles, wherein said liquid carrier contains from about 10% to 90% by weight of the composition of an aliphatic hydrocarbon solvent;

III. an organic suspending agent in sufficient amount to suspend said particles in said liquid carrier; and IV. from 0.1% to 20% by weight of silicone.

2. The invention of claim 1 wherein said resilient fibers have a length of from 4 mm to 8 mm, a diameter of from 30 microns to 60 microns, and a fiber density of at least 1200 fibers/cm$^2$.

3. The invention of claim 1 wherein said dispenser and pad are of a unitary construction, said construction having a means to dispense said liquid cleaner to car surfaces.

4. The invention of claim 1 wherein said container contains from 150 cm$^3$ to 300 cm$^3$ of said liquid cleaner.

5. The invention of claim 1 wherein said pad has a surface area of from 100 cm$^2$ to 200 cm$^2$.

6. The invention of claim 3 wherein said container contains from 150 cm$^3$ to 300 cm$^3$ of said liquid cleaner, and said pad has a surface area of from 100 cm$^2$ to 200 cm$^2$.

* * * * *